US012158148B2

(12) United States Patent
Nuss

(10) Patent No.: US 12,158,148 B2
(45) Date of Patent: Dec. 3, 2024

(54) SCREW PUMP

(71) Applicant: NETZSCH Pumpen & Systeme GmbH, Selb (DE)

(72) Inventor: Eduardo Nuss, Pomerode (BR)

(73) Assignee: NETZSCH Pumpen &Systeme GmbH, Selb (DE)

( * ) Notice: Subject to any disclaimer, the term of this patent is extended or adjusted under 35 U.S.C. 154(b) by 0 days.

(21) Appl. No.: 18/262,259

(22) PCT Filed: Dec. 6, 2021

(86) PCT No.: PCT/EP2021/084345
§ 371 (c)(1),
(2) Date: Jul. 20, 2023

(87) PCT Pub. No.: WO2022/156949
PCT Pub. Date: Jul. 28, 2022

(65) Prior Publication Data

US 2024/0084798 A1 Mar. 14, 2024

(30) Foreign Application Priority Data

Jan. 20, 2021 (DE) ..... 10 2021 101 111.6

(51) Int. Cl.
*F04C 2/16* (2006.01)
*F01C 21/10* (2006.01)
*F04C 15/00* (2006.01)

(52) U.S. Cl.
CPC ..... *F04C 2/16* (2013.01); *F01C 21/102* (2013.01); *F01C 21/108* (2013.01);
(Continued)

(58) Field of Classification Search
CPC .... F04C 2/16; F04C 15/0023; F04C 15/0026; F04C 15/0042; F04C 2240/54;
(Continued)

(56) References Cited

U.S. PATENT DOCUMENTS 4,242,067 A * 12/1980 Segerstrom ..... F04C 2/165 418/197
2015/0369239 A1* 12/2015 Nuss ..... F04C 2/16 418/201.1
2019/0085844 A1* 3/2019 Trossmann ..... F04C 2/165

FOREIGN PATENT DOCUMENTS

DE 3920901 A1 1/1991
DE 102006049663 A1 5/2008
(Continued)

OTHER PUBLICATIONS

EP-889240-A1—Beyer et al.—Screw Rotor Pump—Jan. 7, 1999—the English Machine Translation (Year: 1999).*
(Continued)

*Primary Examiner* — Theresa Trieu
(74) *Attorney, Agent, or Firm* — Whitmyer IP Group LLC

(57) ABSTRACT

A screw pump includes a pump housing in which a pump spindle is rotatably mounted with the involvement of a hydrostatic thrust bearing for absorbing the axial thrust which is produced at the spindle during operation, the hydrostatic thrust bearing being formed by a housing-fixed bearing surface, against which an end-face, spindle-fixed bearing surface of the pump spindle is indirectly supported, by virtue of the fact that the housing-fixed bearing surface and the spindle-fixed bearing surface form a bearing gap therebetween, which bearing gap is fed, in its central region, with a pressure fluid which flows out through the bearing gap in the radial direction, preferably into the intake region, and the hydrostatic pressure of which counteracts the axial thrust.

16 Claims, 3 Drawing Sheets

(52) U.S. Cl.
CPC ..... *F04C 15/0023* (2013.01); *F04C 15/0042* (2013.01); *F04C 2240/54* (2013.01); *F04C 2240/60* (2013.01)

(58) Field of Classification Search
CPC .. F04C 2240/56; F04C 2240/60; F01C 21/02; F01C 21/102; F01C 21/108
See application file for complete search history.

(56) References Cited

FOREIGN PATENT DOCUMENTS

| | | | | |
|---|---|---|---|---|
| DE | 102017121882 | B3 | 1/2019 | |
| EP | 889240 | A1 * | 1/1999 | ..... F04C 15/0042 |

OTHER PUBLICATIONS

DE102006049663A1—Malorny—Screw spindle pump for conveying working fluid, particularly lubricant or cooling lubricant, has pump spindles, which are rotatably mounted in housing, where pump spindles are supported in axial direction by axial bearing in housing—May 8, 2008—the Engl. Transl. (Year: 2008).*
International Search Report and Written Opinion of the International Searching Authority; Application No. PCT/EP2021/084345; Completed: May 23, 2022; Mailing Date: Jun. 1, 2022; 13 Pages.

* cited by examiner

SCREW PUMP

TECHNICAL FIELD

The invention relates to a screw pump according to the claims.

BACKGROUND

Screw pumps are high-performance displacement pumps, by means of which a low-pulsation conveyance of liquids or solids is made possible. The basic principle of a screw pump will initially be explained on the basis of FIG. 1.

A screw pump 1 is shown in an exemplary manner in FIG. 1 in half-section. Only the region of the pump housing 2 and the spindles 3, 4 located therein are illustrated thereby. An illustration of the drive of the drive spindle 3 was forgone.

On its end protruding from the pump housing 2, the drive spindle 3 is driven by a drive. The running spindle 4, which is arranged in the pump housing 2 parallel to the drive spindle 3 and which is not equipped with its own drive, is driven via the drive spindle 3. In the screw pump shown in FIG. 1, only one running spindle 4 is located in the pump housing 2, but it is also conceivable to install a central drive spindle 3 comprising several running spindles 4.

The torque transmission from the drive spindle 3 to the running spindle 4 generally takes place via a hydrodynamic lubricant film, so that a direct contact of drive spindle 3 and running spindle 4 is avoided. In the event of the conveyance of solids, the torque transmission takes place via an additional gear, due to a lack of a hydrodynamic lubricant film. Due to the fact, however, that the present invention relates to a screw pump for conveying fluids, the setup of a screw pump, which is suitable for the solid conveyance, will not be discussed in more detail.

During the operation of the screw spindle 1, conveying chambers form between the drive spindle 3, the running spindle 4, and the pump housing 2. Due to the rotation of the two spindles 3, 4, they move continuously from the suction side in the region of the inflow 5 towards the pressure side in the region of the outflow 6. A negative pressure is created thereby, which effects a suctioning of the medium to be conveyed.

Starting at the inlet, which cannot be seen due to the sectional illustration, the fluid to be conveyed flows via the inflow 5 into the pump housing 2. There, it comes into contact with the spindles 3, 4 and reaches into the conveying chambers, which move in the direction of the outflow 6. The fluid is transported via the conveying chambers into the threadless region of the spindles 3, 4 and accumulates there. Due to the continuous conveyance, the fluid is lastly pumped via the outflow 6 in the direction of the outlet 7.

Due to the increase in pressure during the pumping process, axial forces, for example, act on the spindles 3, 4.

In order to support these axial forces acting on the spindles, corresponding thrust bearings are required. In screw pumps, which are used to convey fluids, hydrostatic thrust bearings are usually used. The thrust bearing has to thereby be designed and structured so that the axial forces acting on the spindle are transferred to the thrust bearing only via a lubricant film, if possible. Solid friction or mixed friction between the spindle and the thrust bearing, respectively, is to be avoided during the operation of the screw pump.

To avoid solid friction and mixed friction, a sufficiently thick lubricant film has to always be present in the thrust bearing. This is attained by means of a continuous application of the thrust bearing with a corresponding lubricant. The use of axial thrust bearings is thus associated with a high lubricant consumption.

The fluid itself, which is to be conveyed, is thus typically used as lubricant. This also has advantages when screw pumps are used in fields, such as, for example, the food industry, in which the use of lubricants, which differ from the fluid to be conveyed, would result in an intolerable contamination risk. Due to the use of the fluid, which is to be conveyed, as lubricant for the thrust bearing, the contamination risk, or the structural effort for avoiding such a contamination risk, respectively, is eliminated.

However, this, in turn, leads to problems when a screw pump is to be used for conveying different fluids with different viscosity. If the thrust bearing is designed, for example, for a highly viscous liquid, the lubricant possibly escapes too quickly from the lubrication point when a low-viscous fluid is to be conveyed. In the event of the design of the bearing for low-viscous fluids, in contrast, the conveyance of highly viscous fluids possibly results in a friction in the bearing, which is too high, because the lubricant escapes from the lubrication point too slowly. Both result in an increased wear on the bearing or on the spindle and thus in a reduction of the service life of the spindle or a shortening of the required maintenance intervals, respectively.

SUMMARY

In view of this, it is the object of the invention to specify a screw pump, in the case of which the influence of the viscosity of the medium to be conveyed on the service life of the screw pump is reduced.

According to the invention, this problem is solved by means of the features of the main claim, which is directed to the screw pump.

The problem is therefore solved by means of a screw pump comprising a pump housing, in which a pump spindle is mounted with the involvement of a hydrostatic thrust bearing. The thrust bearing serves to absorb the axial thrust created during the operation on the spindle. It is formed by a housing-fixed bearing surface, against which an end-face, spindle-fixed bearing surface of the pump spindle is indirectly supported. The support takes place in that the housing-fixed and the spindle-fixed bearing surface form a bearing gap therebetween, which, in its central region, is fed with a pressure fluid, the hydrostatic pressure of which counteracts the axial thrust. The pressure fluid flows out through the bearing gap in the radial direction. It thereby preferably flows into the suction region of the screw pump. The screw pump is characterized in that the pump spindle comprises an actuating element. Due to the actuating element, a valve, which controls the inflow of pressure fluid into the bearing gap, is mechanically opened or closed as a function of the current axial position of the spindle.

The axial forces acting on the spindle during the operation of the screw pump push the spindle in the direction of the thrust bearing. The spindle-fixed bearing surface thereby pushes against the pressure fluid located in the bearing gap. If the pressure fluid now has a low viscosity and flows relatively quickly out of the bearing gap, a sufficiently high static pressure, thus a pressure, which is sufficient to hold the spindle in its current axial position, does not result in the pressure fluid in the bearing gap. The spindle then moves in the direction of the thrust bearing, and the height of the bearing gap, which is filled with pressure fluid, between the spindle-fixed bearing surface and the housing-fixed bearing surface becomes smaller.

Starting at an initial position of the spindle, in which the valve is closed, the axial displacement of the spindle now has the result that the valve is opened by means of the actuating element. The opening and closing movement of the valve preferably takes place continuously.

A volume flow of pressure fluid can then flow into the bearing gap by opening the valve. As soon as this volume flow then equals the volume flow of the pressure fluid, which flows out of the bearing gap, a force balance results in the bearing gap. The amount of the force resulting from the pressure of the liquid in the bearing gap is exactly as large as the axial force, which results from the axial thrust to which the spindle is subjected, and which acts in the reverse direction. The movement of the spindle in the axial direction is thus stopped.

In order to realize the process described in the preceding paragraph, the thrust bearing, the valve, and the actuating element have to be adapted to one another so that a force balance results, which stops the axial spindle movement, before the spindle rests partially on the housing-fixed bearing surface of the thrust bearing. The partial resting of the spindle on the housing-fixed bearing surface would have the result that the force introduction takes place directly and no longer indirectly via the pressure fluid, which induces wear. This can be accomplished in that the spindle position required for completely opening the valve is reached sooner than the spindle position, in which the spindle rests on the thrust bearing, so that the spindle cannot rest on the housing-fixed bearing surface even in consideration of the dynamic component of the spindle movement. If it cannot be ruled out completely that the spindle can in fact temporarily come to rest on the housing-fixed bearing surface, it is advantageous to provide a corresponding thrust ring on the housing-fixed bearing surface, which preferably consists of a bearing metal, which withstands solid or mixed friction, at least temporarily.

In the event that a counter movement of the spindle—away from the thrust bearing—is to also be generated with the help of the thrust bearing when the spindle already rests tightly on the housing-fixed bearing surface, the pressure fluid can be pressed into the bearing gap by means of an additional pump at increased pressure, in order to force an initial lifting of the spindle from the housing-fixed bearing surface. For this purpose, the spindle-fixed bearing surface and the housing-fixed bearing surface of the thrust bearing is to also have a gap therebetween when the spindle rests on the housing-fixed bearing surface.

The term "pump spindle" preferably, but not exclusively, identifies a running spindle. It is also conceivable that the drive spindle is to be understood under the "pump spindle" mentioned here.

Contrary to the above wording, according to which "a" pump spindle is mounted in the pump housing with the involvement of a hydrostatic thrust bearing, the invention also relates to a screw pump comprising a drive spindle and one or several running spindles, one, several, or all of which is mounted with the involvement of a hydrostatic thrust bearing.

The term "in the radial direction", in which the pressure fluid located in the bearing gap flows out, describes that, starting at the central region of the bearing gap, into which it is fed, the pressure fluid initially flows out radially to the outside into the edge region of the bearing gap. It Is in fact conceivable, however, that the pressure fluid in the edge region of the bearing gap is deflected and then flows out in a different direction.

The "suction region" of the screw pump is the region, in which the fluid to be pumped, which has not yet reached the conveying chamber, is located.

There is a number of options for designing the invention so that its effectiveness or usability is even further improved.

It is thus particularly preferred that the valve is operated as throttle valve, the opening degree of which controls the hydrostatic pressure in the bearing gap.

Due to the fact that the opening of the valve takes place as a function of the axial position of the spindle, not only a continuous opening of the valve then takes place as a result of the displacement of the spindle in the direction of the thrust bearing, but the pressure fluid also flows towards the bearing gap at higher pressure, which is why the hydrostatic pressure in the bearing gap increases instantly. As soon as the volume flow flowing towards the bearing gap and the volume flow of the pressure fluid flowing out of the bearing gap are in balance, an essentially hydrostatic stress state results in the pressure fluid.

This, in turn, results in a force balance of the axial forces acting in the thrust bearing, and the axial spindle movement stops. The valve position then remains constant until the axial force acting on the spindle either increases or decreases as a result of the conveying process. In the event of an increasing axial force, the spindle moves further in the direction of the thrust bearing, the valve is further opened, and a fore balance stopping the axial spindle movement results again as a result of the already described processes. In the event of a decreasing axial force on the spindle, the spindle moves in the direction away from the thrust bearing, so that the opening degree of the valve decreases, and a force balance likewise results again.

In a further preferred embodiment, the actuating element is a pin. As soon as the bearing gap falls below a certain gap height due to an axial displacement of the pump spindle, the pin opens the valve or opens it further.

The pin is preferably connected to the spindle-fixed bearing surface of the pump spindle and protrudes through the bearing gap in the direction of the valve. Due to a corresponding movement of the pump spindle in the direction of the bearing gap, the valve is then actuated by means of the pin.

The valve preferably consists of a valve ball, which is pushed onto a valve seat assigned thereto by means of the pressure fluid. The valve ball then blocks the inflow opening, which is located in the center of the valve seat, and which leads to the bearing gap. If necessary, the valve ball is lifted off its valve seat by means of the pin, which engages through the inflow opening, or is further lifted off its valve seat.

The region, in which the valve ball is moved by means of the pin or the actuating element, respectively, when the valve was opened, is thereby preferably designed so that the pressure fluid flowing through the valve flows around the valve ball. As soon as the spindle moves in the direction away from the thrust bearing and the valve ball is no longer held at a distance from the valve seat by means of the actuating element, the flow ensures that the valve ball is pushed back onto the valve seat again.

In a further preferred embodiment, the housing-fixed bearing surface is formed on the bottom of a bearing pot. An end-side bearing journal of the pump spindle, which forms a spindle-fixed bearing surface on the end face, engages with the bearing pot. The bearing journal engages with the bearing pot in such a way that the outer circumferential surface of the bearing journal and the inner circumferential surface of the bearing pot form an annular gap seal. The pressure fluid flows out of the bearing gap in a throttled manner via the annular gap seal. It thereby preferably flows into the suction region.

The bearing journal is ideally formed by a region of the spindle, the diameter of which is smaller than the adjoining section of the spindle, as a result of a shaft shoulder.

The end face of the bearing journal facing the thrust bearing then represents the spindle-fixed bearing surface, which, together with the bottom surface of the bearing pot, forms the thrust bearing.

Due to the annular gap seal, the volume flow of the pressure fluid flowing out of the bearing gap is kept relatively low. The volume flow, which is required for the generation of the required pressure of the pressure fluid located in the bearing gap and which flows towards the bearing gap, is thus likewise relatively low.

Starting at the suction region, into which the pressure fluid flows out of the bearing gap via the annular gap seal, it is mixed with the fluid to be conveyed, which is supplied to the screw pump.

The term "bearing pot" describes a cylindrical hollow body, which is open on one side, wherein the side of the hollow body located opposite the open side has a closed bottom. A bore (a hole, a cutout), through which the pin or the actuating element engages, respectively, is located in the bottom (preferably in the center thereof) of the bearing pot.

The bearing pot ideally rests axially against a wall of the pump housing but is not fixed in a positive manner with respect to the pump housing in the radial direction.

The axial pressure, which is supported in the thrust bearing, and which acts on the spindle as a result of the conveying process, directly or indirectly presses the bearing pot against the pump housing. As a result of the static friction resulting therefrom between the bearing pot and the pump housing or the element located between pump housing and bearing pot, the bearing pot is sufficiently protected against shifting.

The fact that the bearing pot rests axially against "a wall of the pump housing" does not rule out that a further element, into which the valve seat of the above-described valve ball is introduced, is located between the pump housing and the bearing pot. The additional element is to be considered to be a part of the pump housing in this case.

In a further preferred embodiment, the bearing pot rests axially against a wall of the pump housing and is fixed in a positive manner with respect to the pump housing in the radial direction The positive fixation in the radial direction takes place, for instance, by means of pins or screws.

The risk of a shifting of the thrust bearing is additionally reduced thereby. This is advantageous in particular when the pressure fluid has a high viscosity. In the case of highly viscous pressure fluids, shearing stress may possibly result in the region, which adjoins the spindle-fixed bearing surface, of the pressure fluid located in the bearing gap. In the worst case, this can lead to a flow within the pressure fluid located within the bearing gap, which leads to a rotational movement of the bearing pot due to liquid friction in the region between the housing-fixed bearing surface and the pressure fluid. This is prevented by means of a positive fixation of the bearing pot on the pump housing.

The positive fixation of the bearing pot with respect to "the pump housing" does not rule out that an additional element, such as, for example, a plate including the valve seats of the valve, is provided between the pump housing and the thrust bearing. The additional element is to be considered to be a part of the pump housing in this case.

The outer circumferential surface of the bearing journal and the inner circumferential surface of the bearing pot preferably forms a hydrodynamic radial bearing.

The pressure fluid, which flows out of the bearing gap via the gap between the outer circumferential surface of the bearing journal and the inner circumferential surface of the bearing pot, thereby forms the required lubricant film for avoiding solid or mixed friction, respectively.

In a further preferred embodiment, the pressure fluid is the fluid, which is pumped by the screw pump, and which is removed from the pressure side of the screw pump.

For this purpose, a portion of the pressurized fluid from the region of the pressure side of the screw pump is ideally guided back in the direction of the suction side via a duct in the pump housing. There—after it has flown through the valve—it is supplied to the bearing gap.

The bearing journal preferably has a decreased diameter with respect to the immediately adjacent pump spindle region.

This makes it possible, on the one hand, that the spindle rests with the shaft shoulder between the bearing journal and the remaining spindle region on the thrust bearing in the worst case, in which it comes into contact with the thrust bearing. It is ensured thereby that the housing-fixed and the spindle-fixed bearing surface of the thrust bearing never rest on one another and wear. A certain bearing gap, into which the pressure fluid can flow, is thus furthermore always kept open.

The responsiveness of the thrust bearing can additionally be set via the selected diameter of the bearing journal.

Further optional modes of action, advantages, and design options follow from the description of the exemplary embodiment on the basis of the figures.

DETAILED DESCRIPTION

The basic mode of operation of the generic screw pumps has already been explained above on the basis of FIG. 1, to which reference is made.

Figure 1:
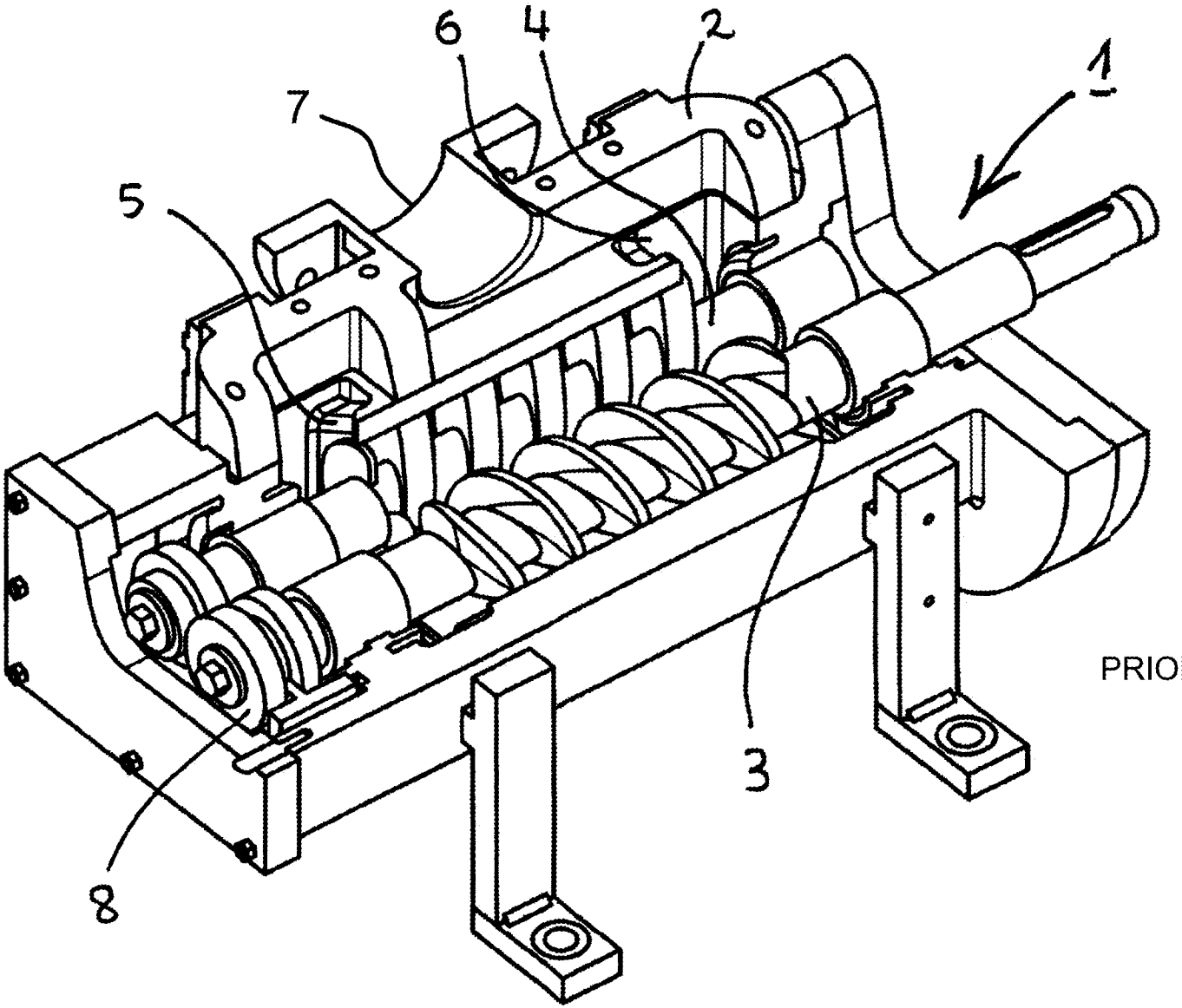
FIG. 1 shows a generic screw pump in half-section.

The further development according to the invention of the screw pump will be explained in an exemplary manner on the basis of FIGS. 2 and 3, but also with a sideways glance at FIG. 1, which forms the starting point.

The principle of the thrust bearing 8 according to the invention as well as of the valve 15 shall be explained initially in very general terms.

A pressure acting on the fluid to be conveyed results on the pressure side of the screw pump 1 during the operation of the screw pump 1. This results in an axial force, which acts on the running spindle 4 and which pushes the latter in the direction of the thrust bearing 8, in FIG. 2 from the right to the left.

The thrust bearing 8 comprises a housing-fixed bearing surface 9 and a spindle-fixed bearing surface 10.

The housing-fixed bearing surface 9 is formed here by the bottom of a bearing pot 12. For the most part, the spindle-fixed bearing surface 10 is formed by the end face of a bearing journal 13. A bearing gap 11 is always located here between the two bearing surfaces 9 and 10. Even if the spindle 4 were to rest with its shoulder 25 on the thrust bearing 8, which is usually not the case during the error-free operation of the screw pump 1, the two bearing surfaces 9 and 10 generally do not rest on one another.

A pressure fluid, which, in the case of this exemplary embodiment, is a portion of the fluid to be conveyed, which is located on the pressure side of the screw pump 1, flows into the bearing gap 11 via the return duct 23 as well as the chamber 24 and the inflow opening 18 of the valve 15.

At the same time, the pressure fluid located in the bearing gap 11 initially flows radially to the outside. It subsequently flows out of the bearing gap 11 via the gap between the bearing pot 12 and the bearing journal 13.

As long as the volume flow flowing into the bearing gap 11 and the volume flow flowing out of the bearing gap 11 are of equal size, an at least approximately hydrostatic stress state results in the pressure fluid at least in the central region of the bearing gap 11—when the running spindle 4 experiences axial thrust as a result of the pressure prevailing on the pressure side of the screw pump 1 and is thus pushed in the direction of the thrust bearing 8. The spindle-fixed bearing surface 10 can then be indirectly supported on the housing-fixed bearing surface 9 via the pressure fluid.

Without the actuating element in the form of the pin 14, the valve ball 16 would be moved in the direction of the valve seat 17 by means of the pressure fluid flowing through the chamber 24 and would close the inflow opening 18 of the valve 15. As soon as the volume flow flowing into the bearing gap 11 is reduced due to the valve ball 16, which approaches the valve seat 17, more pressure fluid flows out of the bearing gap 11 than flows into it.

In combination with the axial force acting on the spindle 4, this results in a movement of the spindle 4 in the direction of the thrust bearing 8 and therefore in a reduction of the distance between the bearing surfaces 9 and 10. However, the actuating element in the form of the pin 14, which is located on the spindle-fixed bearing surface 10, together with the spindle 4 is thereby also moved in the direction of the valve ball 16. In the course of this, the pin 14 comes into contact with the valve ball at some point and prevents a complete closure of the inflow openings 18 through the valve ball 16 or pushes the valve ball 16 further into the chamber 24, respectively.

The movement of the spindle 4 and of the pin 14 as a result of the pressure on the pressure side of the screw pump 1 in the direction of the thrust bearing 8 continues until the valve ball 16 has been pushed into the chamber 24 to the extent that the volume flow flowing to the bearing gap 11 and the volume flow flowing out of the bearing gap 11 are in balance. A hydrostatic state then approximately results again in the pressure fluid located in the bearing gap 11, and the spindle-fixed bearing surface 10 is indirectly supported on the hosing-fixed bearing surface 9 via the pressure fluid. The movement of the spindle 4 in the direction of the thrust bearing is thus stopped.

The volume flow flowing into the bearing gap 11 thus always results independently as a function of the pressure prevailing on the pressure side of the screw pump 1 as well as of the position of the spindle 4, so that a state of balance is created.

Figure 2:
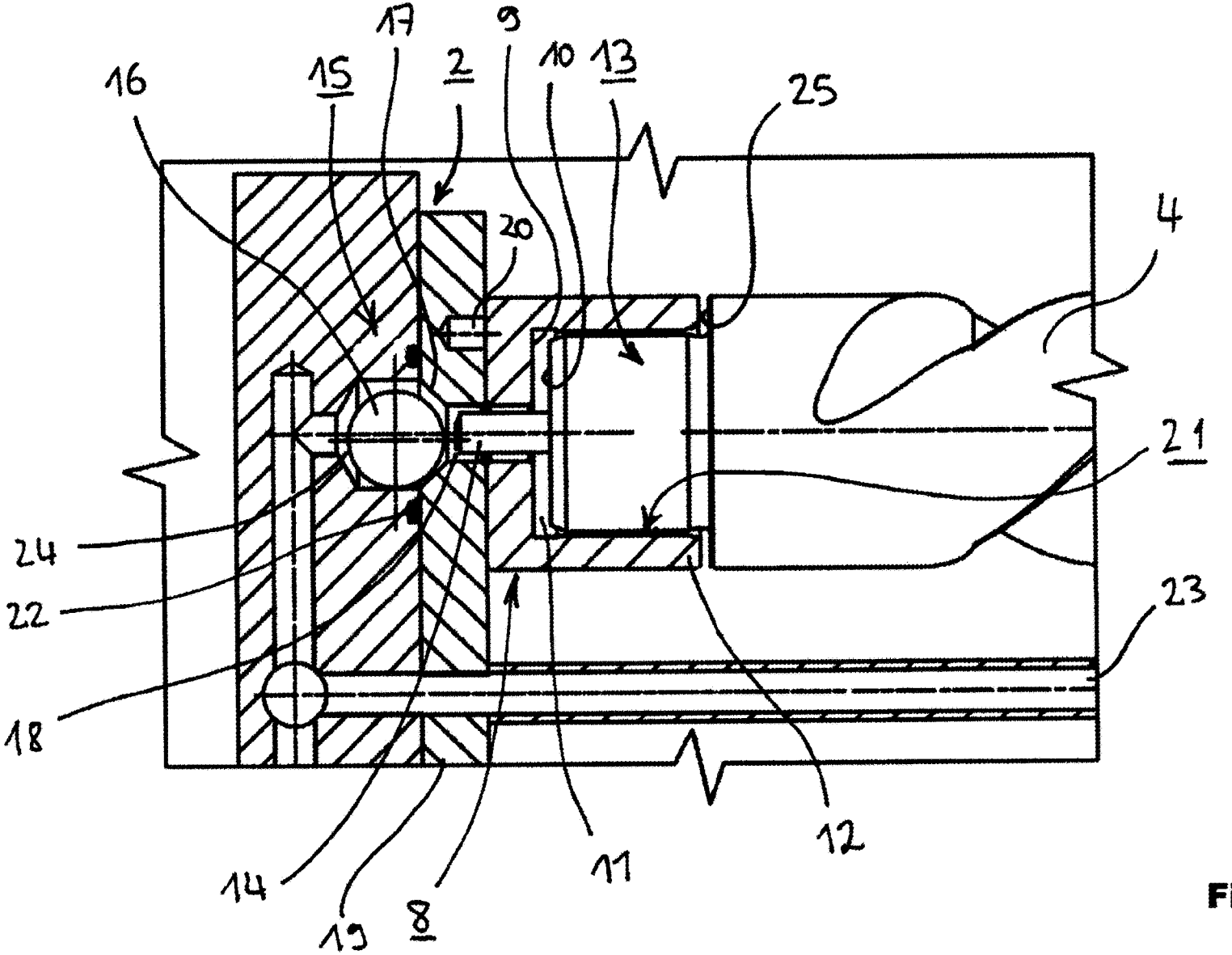
FIG. 2 shows the region of the thrust bearing in the sectional view, wherein an axial force is not yet applied to the spindle.

A state of the screw pump 1 is illustrated in FIG. 2, in which pressure is not yet applied on the pressure side to the fluid, which is pumped through the screw pump 1. An axial force pushing the running spindle 4 in the direction of the thrust bearing 8 thus also does not yet act on the running spindle 4. The fluid located in the return duct 23 is additionally not under pressure yet. As long as an axial force does not yet act on the running spindle 4, the distance between the bearing pot 12 of the thrust bearing 8 and the shaft shoulder 25 at the transition between the bearing journal 13 and the remaining running spindle 4 is still relatively large. The actuating element embodied as pin 14 is additionally not yet in contact with the valve ball 16 of the valve 15. Due to the fact that no flow prevails in the return duct 23 and the chamber 24, the valve ball 16 rests on the bottom of the chamber 24 and not on the valve seat 17 of the valve due to the force of gravity.

Figure 3:
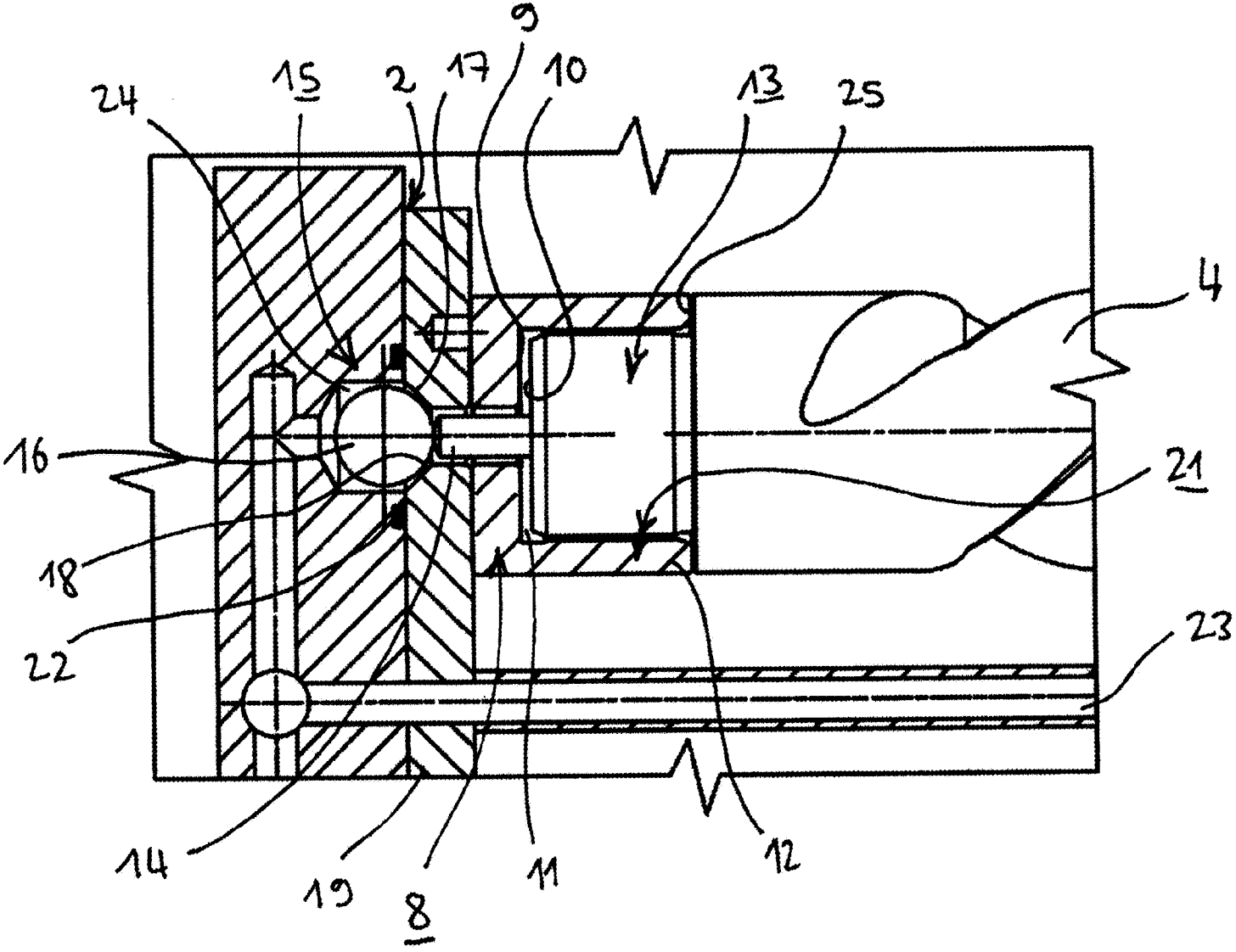
FIG. 3 shows the region of the thrust bearing in the sectional view, wherein an axial force is applied to the spindle.

The state of the spindle pump 1 is shown in FIG. 3, in which the spindle 4 has already been moved in the direction of the thrust bearing 8 as a result of a pressure prevailing on the pressure side of the spindle pump 1. Only a minimal gap, which cannot be seen in FIG. 3, is thereby still located between the shaft shoulder 25 and the bearing pot 12. The pin 14 is already in contact with the valve ball 16 and lifts the latter off the valve seat 17.

The valve seat 17 of the valve 15 as well as the inflow opening 18 are introduced into a wall element 19, which is located between the remaining pump housing 2 and the bearing pot 12. The bearing pot 12 is secured against a shifting or twisting along the wall element 19 via a pin 20. An axial securing of the bearing pot 12 with respect to the wall element 19 is not required because the forces resulting on the thrust bearing 8 always push the bearing pot 12 in the direction of the wall element 19. An O-ring seal 22 is located between the wall element 19 and the remaining pump housing.

In cooperation with the pressure fluid, which flows out of the bearing gap 11 through the gap between the bearing pot 12 and the bearing journal 13, the bearing pot 12 and the bearing journal 13 form a hydrodynamic radial bearing 21 for the spindle 4.

The invention claimed is:

1. A screw pump comprising a pump housing, in which a pump spindle is rotatably mounted with the involvement of a hydrostatic thrust bearing to absorb an axial thrust created during the operation on the spindle, wherein the hydrostatic thrust bearing is formed by a housing-fixed bearing surface, against which an end-face, spindle-fixed bearing surface of the pump spindle is indirectly supported, wherein the housing-fixed bearing surface and the spindle-fixed bearing surface form a bearing gap therebetween, wherein the bearing gap in a central region is fed with a pressure fluid, which flows out through the bearing gap in a radial direction into a suction region and a hydrostatic pressure of which counteracts the axial thrust, wherein the pump spindle includes an actuating pin, which, as a function of a current axial position of the spindle, mechanically opens or closes a valve, said valve controlling an inflow of the pressure fluid into the bearing gap.

2. The screw pump according to claim 1, wherein the valve is operated as throttle valve, the opening degree of which controls the hydrostatic pressure in the bearing gap.

3. The screw pump according to claim 2, wherein the actuating pin opens or further opens said valve as soon as the bearing gap falls below a certain gap height due to an axial displacement of the pump spindle.

4. The screw pump according to claim 2, wherein the housing-fixed bearing surface is formed on the bottom of a bearing pot, with which an end-side bearing journal of the pump spindle, which forms the spindle-fixed bearing surface on the end face, engages in such a way that an outer circumferential surface of the bearing journal and an inner circumferential surface of the bearing pot form an annular gap seal, via which the pressure fluid flows out of the bearing gap in a throttled manner.

5. The screw pump according to claim 4, wherein the pressure fluid flows out of the bearing gap into the suction region.

6. The screw pump according to claim 2, wherein the pressure fluid is the fluid pumped by the screw pump and which is removed from the pressure side of the screw pump.

7. The screw pump according to claim 1 wherein the actuating pin opens or further opens said valve as soon as the bearing gap falls below a certain gap height due to an axial displacement of the pump spindle.

8. The screw pump according to claim 7, wherein the valve consists of a valve ball, which is pushed onto a valve seat assigned thereto by the pressure fluid and then blocks an inflow opening of the valve, which is located in the center of the valve seat and which leads to the bearing gap and which, if necessary, is lifted off its valve seat by the actuating pin, which engages through the inflow opening, or is further lifted off its valve seat.

9. The screw pump according to claim 1, wherein the housing-fixed bearing surface is formed on the bottom of a bearing pot, with which an end-side bearing journal of the pump spindle, which forms the spindle-fixed bearing surface on the end face, engages in such a way that an outer circumferential surface of the bearing journal and an inner circumferential surface of the bearing pot form an annular gap seal, via which the pressure fluid flows out of the bearing gap in a throttled manner.

10. The screw pump according to claim 9, wherein the bearing pot rests axially against a wall of the pump housing, but is not fixed in a positive manner with respect to the pump housing in the radial direction.

11. The screw pump according to claim 9, wherein the bearing pot rests axially against a wall of the pump housing and is fixed in a positive manner with respect to the pump housing in the radial direction.

12. The screw pump according to claim 11, wherein the outer circumferential surface of the bearing journal and the inner circumferential surface of the bearing pot form a hydrodynamic radial bearing.

13. The screw pump according to claim 11, wherein the bearing pot is fixed in the positive manner with respect to the pump housing by pins or screws.

14. The screw pump according to claim 9, wherein the bearing journal has a decreased diameter with respect to the immediately adjacent pump spindle region.

15. The screw pump according to claim 9, wherein the pressure fluid flows out of the bearing gap into the suction region.

16. The screw pump according to claim 1, wherein the pressure fluid is the fluid pumped by the screw pump and which is removed from the pressure side of the screw pump.

* * * * *